United States Patent [19]

Noji et al.

[11] Patent Number: 4,740,683

[45] Date of Patent: Apr. 26, 1988

[54] X-RAY IMAGE INTENSIFIER WITH PHOSPHOR LAYER OF VARYING THICKNESS

[75] Inventors: Takashi Noji, Odawara; Shigeharu Kawamura, Yokohama, both of Japan

[73] Assignee: Kabushiki Kaisha Toshiba, Kawasaki, Japan

[21] Appl. No.: 31,884

[22] Filed: Mar. 30, 1987

[30] Foreign Application Priority Data

Mar. 31, 1986 [JP] Japan ..... 61-70854

[51] Int. Cl.[4] ..... H01J 31/50; H01J 40/14

[52] U.S. Cl. ..... 250/213 VT; 313/527; 313/543

[58] Field of Search ..... 250/213 VT; 313/527, 313/543

[56] References Cited

U.S. PATENT DOCUMENTS 3,716,713 2/1973 Levin ..... 250/213 VT 4,645,971 2/1987 Ricodeau ..... 313/527

FOREIGN PATENT DOCUMENTS 0021805 2/1980 Japan ..... 313/527

*Primary Examiner*—David C. Nelms

*Assistant Examiner*—Michael Messinger

*Attorney, Agent, or Firm*—Cushman, Darby & Cushman

[57] ABSTRACT

An X-ray image intensifier includes an input surface and an output surface facing the input surface. The input surface has a base and a phosphor layer formed on the base and having a predetermined effective radius. The phosphor layer includes a thickest portion which has a thickness about 105 to 115% of a thickness of a center of the layer and is located in a region spaced from the center toward the periphery of the layer by a distance about 60 to 80% of the effective radius. The phosphor layer is formed so that the thickness is gradually increased from the center to the thickest portion and a region between the thickest portion and the periphery of the layer has a thickness about 50 to 100% of the thickness of the thickest portion.

7 Claims, 4 Drawing Sheets

X-RAY IMAGE INTENSIFIER WITH PHOSPHOR LAYER OF VARYING THICKNESS

BACKGROUND OF THE INVENTION

The present invention relates to an X-ray image intensifier.

As X-ray image intensifiers (to be referred to as "I.I."s hereinafter), a general-purpose single visual field type I.I. and a high-grade variable visual field type I.I. are frequently used. In general, an I.I. comprises a vacuum housing which includes a substantially cylindrical outer casing, and an X-ray entrance window and an X-ray exit window which are arranged to close two ends of the outer casing. In the vacuum housing, input and output surfaces are arranged along the entrance and exit windows, respectively, and a focusing electrode constituting an electronic lens is located between the input and output surfaces. The I.I.s are classified into the single visual field type and variable visual field type due to differences in the number and arrangement of focusing electrodes, and the like. In the case of a variable visual field type I.I., when a voltage distribution to the focusing electrodes is switched, an output visual field image can be enlarged like, a normal visual field, a second visual field, a third visual field,....

The input surface has a base and a phosphor screen formed on the base, and has an arcuated circular shape.

In U.S. Pat. No. 3,716,713, the thickness of the phosphor screen is increased from its center toward the periphery, and is maximized at the periphery.

According to an I.I. disclosed in Japanese Patent Disclosure No. 53-102663, the phosphor screen has the same arrangement as that in the above U.S. Pat. No., and the base has a mosaic structure having a large number of grooves for effecting a light guide function.

According to an I.I. disclosed in Japanese Patent Disclosure No. 59-207551, the thickness of the phosphor screen is decreased from its center toward the periphery, and X-ray optical path lengths passing through the phosphor screen are adjusted to be equal to each other at the center and the periphery of the phosphor screen.

In the I.I.s having the above-mentioned arrangements of the input surfaces, the characteristic of an image obtained at the output surface, in particular, a luminance distribution characteristic, is such that a luminance is high at the center of the image and is gradually decreased toward the periphery. Therefore, a luminance distribution curve obtained as a result of measurement along the diameter of an image becomes a quadratic curve. In the variable visual field I.I., the same luminance distribution characteristic is obtained either in a normal visual field operation or in an enlarged visual field operation.

The reason for the above-mentioned luminance distribution can be considered as follows.

In the I.I.s disclosed in U.S. Pat. No. 3,716,713 and Japanese Patent Disclosure No. 53-102663, in order to prolong an X-ray passage distance in the phosphor screen, which influences light emission, so as to compensate for a quantity of light emitted from the phosphor screen, the thickness of the peripheral portion of the phosphor screen is increased. However, a portion between the intermediate portion and periphery of the phosphor screen cannot provide a similar effect upon increase in thickness, and, to the contrary, the luminance of the periphery of an image is decreased. This is because an excessive increase in thickness at the peripheral portion of the phosphor screen does not contribute to light emission of the phosphor by means of X-rays but degrades a transmittance of X-rays.

In Japanese Patent Disclosure No. 59-207551, in order to obtain a constant passage distance of X-rays at respective positions in the phosphor screen, the thickness of the phosphor screen is decreased at a given rate from its center toward the periphery. However, in order to obtain a theoretical luminance, the phosphor screen must be formed to have a uniform structure and a uniform emission intensity distribution. If these conditions cannot be satisfied, the luminance at the peripheral portion of an image, in particular, an area shifted from the center of the image toward the periphery by a distance 80 to 95% of an effective image diameter, is considerably decreased as compared to the above two prior arts.

When the I.I.s having the above luminance distribution characteristic are used, the following problems are posed. In the distribution characteristic, the luminance at the center of an image is high and is decreased toward the periphery. When the I.I. is coupled to an optical system, a luminance difference between the center and the periphery of the image is emphasized due to an operation of the optical system. For this reason, a dark portion at the peripheral portion of the image has degraded discriminating ability of an object, and cannot be used for observing an object. Therefore, a virtual image area is decreased. When an object is observed upon clinical examination, a contour image of the object must be confirmed. However, when the effective image area is small as described above, the I.I. must be moved stepwise so that a portion to be observed is located at the center of the image. For this reason, the observation requires a long time, and an X-ray irradiation time is also prolonged. For example, when an observation is performed using a TV fluoroscopic imaging method, the entire object, i.e., the entire image, must be scanned, and this requires still more time.

In the enlarged visual field operation mode, e.g., in the second visual field operation mode, the luminance distribution characteristic of an output image is such that the center of an image is bright and the peripheral portion thereof is dark as in the normal visual field operation mode. In any visual field operation mode, an area of an input visual field is changed, but an image area which can be observed is almost not changed. For this reason, when the enlarged visual field operation is performed in order to microscopically observe the object after the contour image of the object is confirmed, the I.I. must be moved to locate the object at the center of image. If the object is a moving body, and is moved to the peripheral portion of an output image, the object cannot be discriminated since the luminance of the peripheral portion is low.

Since the luminance distribution characteristic is not changed in the enlarged visual field operation mode, a low luminance portion is moved upon switching of visual fields. The object is often out of sight upon switching of the visual fields, and the I.I. must be moved to confirm the object at that time. For example, upon clinical examination wherein a change in object must be immediately judged, such as blood vessel imaging, the lack of necessary data and the complicated operations as described above may cause serious problems.

SUMMARY OF THE INVENTION

The present invention has been made in consideration of the above situation, and has as its object to provide an X-ray image intensifier which can obtain an output image having the same level of luminance as that at the center of the output image over a wide range, and has a wide effective image area which can be used for observation.

In order to achieve the above object, according to an X-ray image intensifier of the present invention, a phosphor screen has a thickest portion having a thickness about 105 to 115% of that of the center of the phosphor screen in a region away from the center toward the periphery of the phosphor screen by a distance about 60 to 80% of an effective radius of the phosphor screen, and is formed such that the thickness is gradually increased from the center to the thickest portion of the phosphor screen, and a region between the thickest portion and the periphery of the phosphor screen has a thickness about 50 to 100% of that of the thickest portion.

BRIEF DESCRIPTION OF THE DRAWINGS

FIGS. 1 to 8 show an X-ray I.I. according to an embodiment of the present invention, in which:

FIG. 1 is a longitudinal sectional view of the I.I.;

FIG. 2 is a schematic view showing the relationship between the I.I. and an X-ray tube;

FIG. 3 is a view showing a change in thickness along the radial direction of a phosphor screen;

FIG. 4 is an enlarged sectional view showing a part of an input surface;

FIG. 5 is a view showing a change in luminance in accordance with a change in thickness;

FIG. 6 is a view showing the relationship between a thickness and a noise level;

FIG. 7 is a view showing a change in luminance in accordance with changes in various factors along the radial direction of an output image; and FIG. 8 is a view showing a luminance distribution of an output image.

DETAILED DESCRIPTION OF THE PREFERRED EMBODIMENT

An embodiment of the present invention will now be described with reference to the accompanying drawings.

Figure 1:
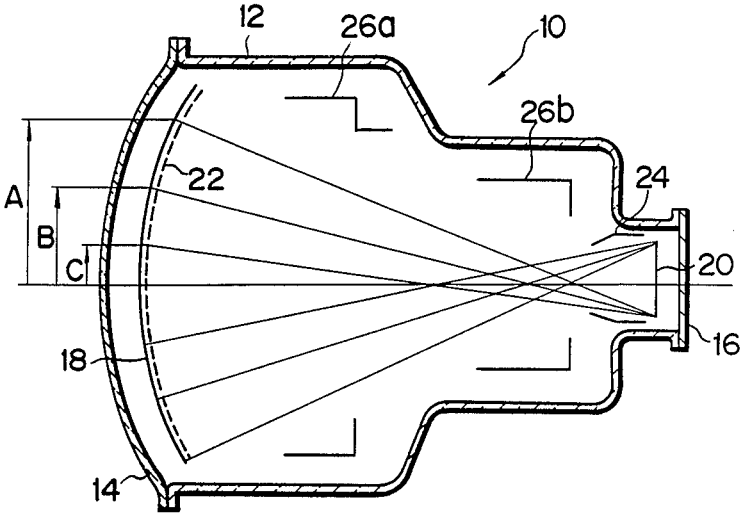

As shown in FIG. 1, an I.I. comprises outer housing 10, the interior of which is held in vacuum. Housing 10 has substantially cylindrical outer casing 12, entrance window 14 which is arranged to close one end of casing 12, and exit window 16 which is arranged to close the other end of casing 12 and faces entrance window 14. In housing 10, convex circular input surface 18 is arranged along entrance window 14 and circular output surface 20 is arranged along exit window 16. Photoelectric surface 22 is formed on input surface 18 on the side of output surface 20, and anode 24 is arranged near output surface 20. A pair of focusing electrodes **26*a* and 26*b* are provided between photoelectric surface 22 and anode 24**, and constitute an electronic lens together with the anode.

Figure 2:
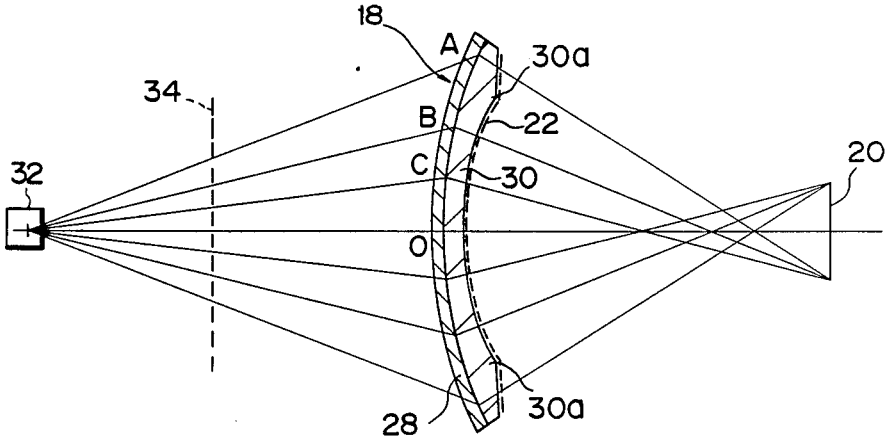

As shown in FIG. 2, input surface 18 is arcuated outwardly in a convex shape, and has circular base 28 and phosphor layer 30 formed on the surface of base 28 on the side of output surface 20. Output surface 20 has a circular shape, and a phosphor layer (not shown) is formed on its surface on the side of input surface 18. X-rays radiated from X-ray tube 32 pass through object 34, and are then incident on the I.I., thereby forming an X-ray image on input phosphor layer 30. The X-ray image is converted to a visible optical image by phosphor layer 30, and the visible optical image causes photoelectric surface 22 to emit photoelectrons. The photoelectrons are focused and accelerated by the electronic lens constituted by focusing electrodes **26*a* and 26*b* and anode 24**, and form an electron image on the output phosphor layer. The electron image is converted to a visible optical image, e.g., an output image, by the output phosphor layer.

The I.I. is a variable visual field type I.I., the input visual field of which can vary upon change in distribution of voltage applied to focusing electrodes **26*a* and 26*b*, and anode 24**. More specifically, the I.I. of this embodiment is a triple visual field type I.I. having normal visual field A, second visual field B, and third visual field C. In the case of the triple visual field type I.I. having the input visual fields of 12 inch/9 inch/6 inch, the diameters of normal visual field A, second visual field B, and third visual field C are respectively 300 mm, 230 mm, and 152 mm.

In the actual positional relationship among the respective members in FIG. 2, the distance between X-ray tube 32 and input surface 18 is about 1 m, the radial distance from center O of input surface 18 to the periphery of normal visual field A is about 20 cm in the case of 12 inch, and is about 12 cm in the case of 9 inch. The distance between input surface 18 and output surface 20 is about 30 cm. The radius of curvature of base 28 is about 300 mm in the case of 12 inch, and is about 200 mm in the case of 9 inch.

As shown in FIG. 2, input phosphor layer 30 consists of an alkali halide deposition film, and has a thickness distribution having thickest portion **30*a* between the periphery of normal visual field A and second visual field B. More specifically, if the distance between center O of phosphor layer 30 and the periphery of normal visual field A along the surface of base 28 is assumed to be an effective radius of phosphor layer 30, thickest portion 30*a* is located at an area spaced from center O by a distance 60 to 80% of the effective radius in the radial direction. The thickness of phosphor layer 30 is gradually increased from center O to thickest portion 30*a*. The increasing rate of the thickness is about 1 to 3 μm/cm in the radial direction. When the thickness at the center of phosphor layer 30 exceeds 350 μm, the increasing rate of the thickness is preferably 0.2 to 1.5 μm/cm. The thickness of a region between thickest portion 30*a*** and the periphery of normal visual field A is then moderately decreased at a decreasing rate of 0 to 7 μm/cm.

Figure 3:
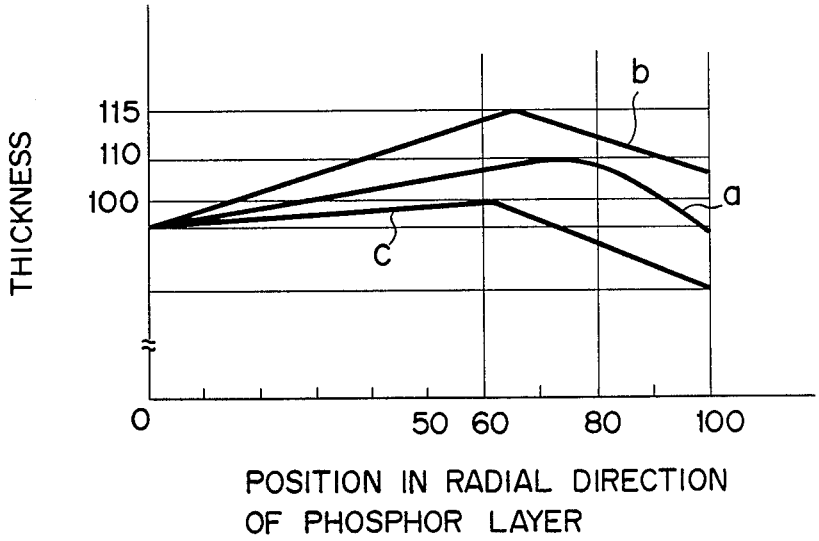

The thickness distribution of phosphor layer 30 is as shown in FIG. 3. In FIG. 3, the abscissa represents a distance from center O of phosphor layer 30 along base 28 to have the center as 0 and the periphery of the effective radius, i.e., the periphery of normal visual field A as 100. The ordinate represents the thickness of phosphor layer 30 to have the central thickness as 100. Curve a indicates a typical thickness distribution, curve b indicates an upper-limit thickness distribution, and curve c indicates a lower-limit thickness distribution, respectively.

As can be seen from FIG. 3, the thickest portion is located at a 60 to 80% position and has a thickness 105 to 115% of the thickness at the center. The region between the thickest portion and the effective radius periphery has a thickness 50 to 100% of that at the thickest portion.

Figure 4:
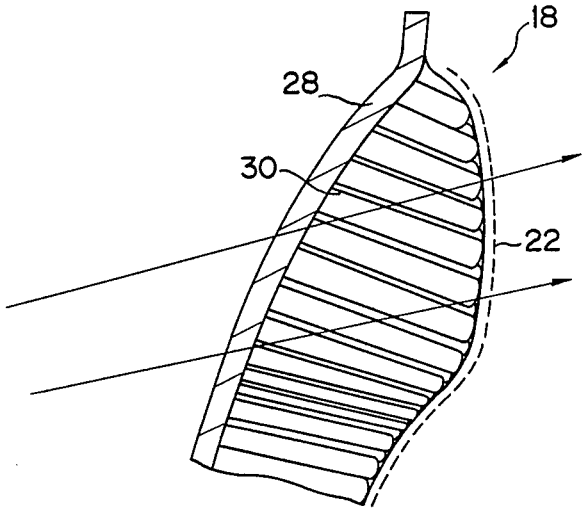

If phosphor layer 30 is formed by an alkali halide deposition method, an alkali halide particularly has a low melting point, and has a wide evaporation angle distribution from an evaporation source. For this reason, when an opening shape of the evaporation source is corresponded to the evaporation angle distribution, phosphor layer 30 can be formed to have a desired thickness distribution as described above. As shown in FIG. 4, since phosphor layer 30 is formed under the controlled conditions, it consists of columnar crystals having a diameter of 20 μm or less, as disclosed in U.S. Pat. No. 4,437,011. Therefore, phosphor layer 30 can obtain a high resolution characteristic and has a light guide function without cracking. Since phosphor layer 30 can obtain the above characteristic by selecting formation conditions of the CsI columnar crystals, even if the thickness of the center of phosphor layer 30 is increased to be relatively thick (e.g., 230 to 530 μm), a higher resolution can be obtained than that of the conventional phosphor layer. In addition, an X-ray absorption power is extremely high. X-rays which become incident on input surface 18, as indicated by arrows in FIG. 4, excite the phosphor in accordance with their intensities and absorption distances, i.e., a passage distance in phosphor layer 30. The X-ray intensity changes according to an X-ray generation distribution of the X-ray tube and the position of input surface 18, and the intensity of X-rays incident on the peripheral portion of phosphor layer 30 is lower than that incident on the center. The X-ray absorption distance is prolonged as for the X-rays incident on the periphery of phosphor layer 30. Of phosphor layer 30, in a region spaced from the center of phosphor layer 30 by 70% of the effective radius, the X-ray absorption distance becomes 1.2 to 3 times that at the center of phosphor layer 30. A quantity of light which is generated by exciting phosphor layer 30 and is absorbed by photoelectric surface 22 determines a luminance of an output image. If photoelectric surface 22 formed on phosphor layer 30 has a uniform thickness, the influence of surface 22 on the luminance is uniform over the entire surface.

Figure 5:
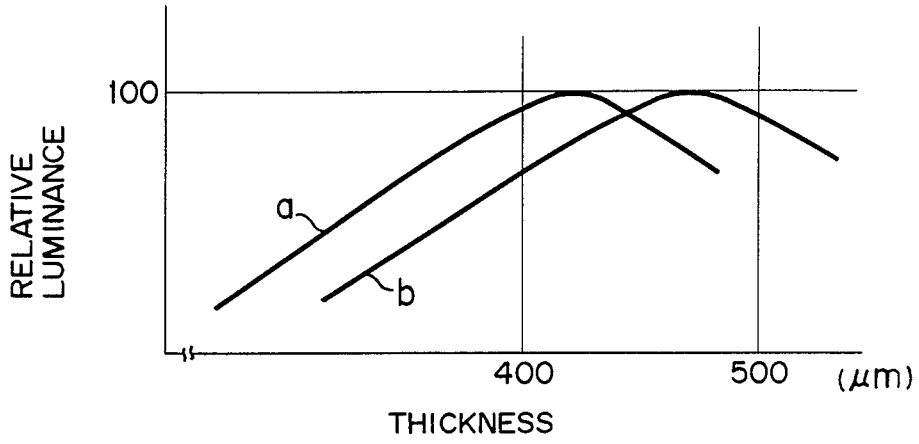

FIG. 5 shows the relationship between the thickness of the phosphor layer and the luminance of the output image, in accordance with energy of X-rays. In FIG. 5, characteristic curve a represents a case wherein the crystal size of phosphor layer 30 falls within the range of 5 to 10 μm, and characteristic curve b represents a case wherein the crystal size falls in the range of 12 to 20 μm. The thickness of phosphor layer 30 maximizing the luminance under the conditions applicable to X-ray diagnosis falls within the range of 400 to 470 μm if CsI/Na is used as the phosphor. When a portion having the maximum thickness is located in a region separated from the center of the phosphor layer toward the periphery by a distance 70% of the effective radius of the phosphor layer, the thickness of the center of the phosphor layer falls within the range of 380 to 450 μm, and the thickness of the peripheral portion falls within the range of 190 to 450 μm.

Figure 6:
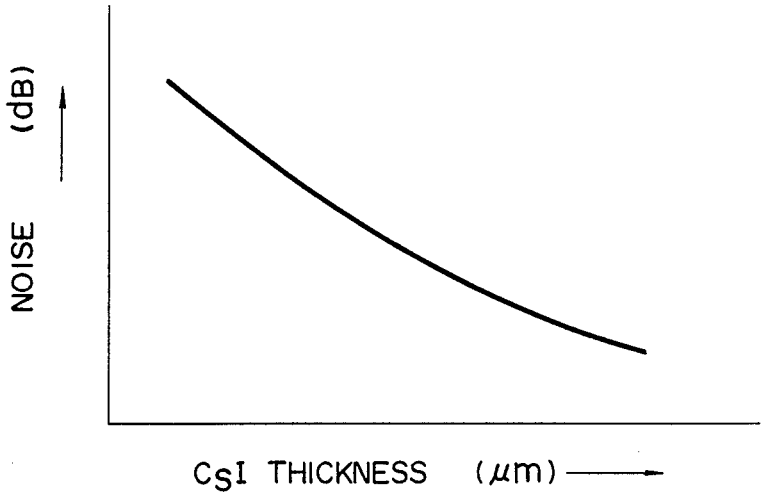

As shown in FIG. 6, an increase in thickness of phosphor layer 30 noticeably influences the quality of the output image. In other words, this induces an improvement of X-ray absorption ability of the phosphor layer, and eliminates noise due to X-ray photons. The reduced noise can eliminate flickering of the output image. As a result, when a minute portion is microscopically examined, this portion can be easily discriminated. Therefore, the thickness of the center of phosphor layer 30 must fall within the range of 200 to 600 μm, and preferably falls within the range of 280 to 550 μm. In the phosphor layer of 9 inch, output of 20 ϕmm, a thickness necessary for obtaining a resolution of 50 lp/cm is 280 μm, and a thickness, which makes it difficult to compensate for a decrease in luminance caused by the phosphor layer by improvement of luminance of the photoelectric surface and the output surface, is 550 μm. Therefore, in order to reduce noise over the entire surface of the output surface, the minimum thickness of a thickness decreasing region, i.e., a region from the thickest portion to the periphery, is preferably set to be larger than the thickness of the center of the phosphor layer. The thickness decreasing region is located to be separated from the center of the phosphor layer toward the periphery by a distance 90% of the effective radius.

Figure 7:
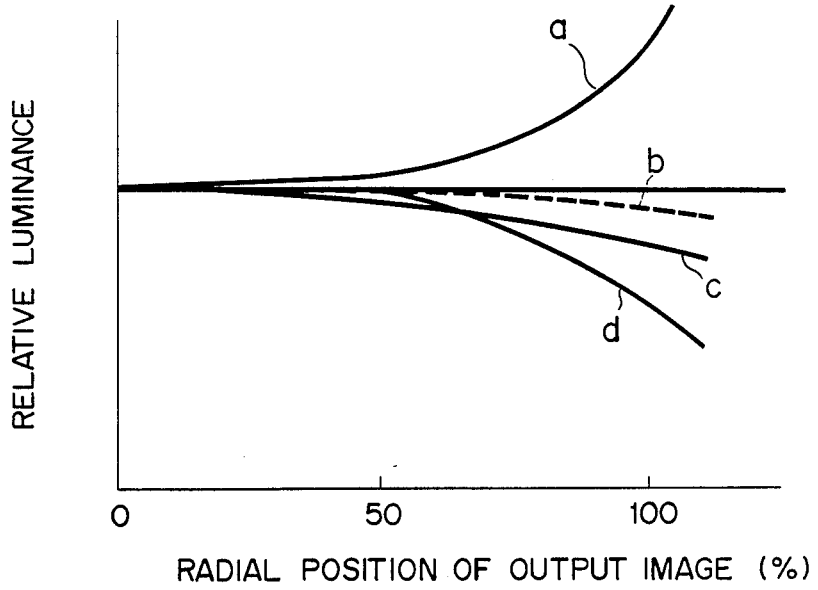

The influence of the thickness distribution of the phosphor layer on the luminance of the output image will be explained with reference to FIG. 7. In FIG. 7, the abscissa indicates a distance in the radial direction of the output image, 0 corresponds to the center, and 100 corresponds to the periphery of the image. The ordinate represents a relative luminance. Curve a represents a change in luminance according to an X-ray passage distance in phosphor layer 30, curve b represents a change in luminance according to X-ray absorption other than the phosphor layer, curve c represents a change in luminance according to an X-ray intensity, and curve d represents a change in luminance according to distortion.

As can be seen from FIG. 7, influences of pincushion distortion, X-ray intensity, and X-ray absorption distance on the luminance change in accordance with the radial position of the output image. In order to make the luminance of the output image uniform, the thickness of the phosphor layer is set in consideration of the above factors.

First, a pincushion distortion will be explained. An image focused on the output surface is influenced by the operation of the electronic lens, and includes pincushion distortion. The pincushion distortion enlarges a unit size in the input surface, and as a result, an image is expanded, resulting in a decrease in luminance. In the case of the variable visual field type I.I., it is designed through high-precision calculations, and includes many electrodes, e.g., 3 to 6 electrodes. Therefore, almost no pincushion distortion occurs at the center portion of image. In this case, the center portion of image includes a region between the center of the image and a region 50 to 60% of the effective radius. The center portion of the phosphor layer corresponding to that of the image is located to be perpendicular to the optical axis of the X-ray tube, and an increasing rate of the thickness in the radial direction is very small. Therefore, the luminance at the center portion of the image becomes substantially uniform. The pincushion distortion gradually increases from the center of the output image toward the periphery, and the luminance of the image is decreased accordingly. In a region of the output image corresponding to the thickest portion of the phosphor layer, although a change in pincushion distortion along the tangential direction of the phosphor layer is small, a change along the radial direction is large, and is larger about 20% than a changing ratio of the distortion of the center of the image, according to the types of the I.I.

Therefore, when a changing ratio of the distortion along the tangential direction is 1%, the luminance of the above region decreases at a ratio 20% larger than that of the center portion.

The intensity of X-rays is gradually decreased from the center of the phosphor layer toward the periphery, and as a result, the luminance of the image is gradually decreased from the center of the image toward the periphery due to a change in X-ray intensity. For example, the intensity of X-rays incident on the thickest portion of the phosphor layer is weakened by about 5% than that of X-rays incident on the center of the phosphor layer.

Furthermore, the X-ray passage distance is gradually increased from the center of the phosphor layer toward the periphery, and the luminance of the output image is also increased due to a change in distance. The X-ray passage distance changes according to a change in thickness of the phosphor layer. When the thickness is 400 μm or more at the center of the phosphor layer, an increasing rate of the X-ray passage distance along the radial direction is large. For this reason, the increasing rate of the thickness at the center portion of the phosphor layer is set to be small, i.e., 0.2 to 1 μm/cm, and the thickness of this portion can be substantially uniform. The thickest portion has a moderately arcuated film thickness, and the passage distance of X-rays passing through this region is sufficiently large. This region corresponds to a portion through which X-rays having an intermediate intensity pass, and sufficiently absorbs the X-rays, thus greatly contributing to an increase in luminance of the image. In the case of a 12-inch visual field I.I., the thickest portion is formed on a region of the radius of 100 to 140 mm of the phosphor layer. The film thickness of this portion is about 320 μm if the film thickness of the center of the phosphor layer is 300 μm, and the increasing rate of the film thickness need not be so high.

Since the peripheral portion of the phosphor layer is arcuated in a direction apart from the X-ray tube, the incident angle of the X-rays incident on the peripheral portion is gradually decreased. For this reason, a passage distance of the X-rays is increased toward the periphery as compared to the central portion of the phosphor layer. The X-ray passage distance virtually contributing to light emission is a distance along the incident direction of the X-rays, so that a thickness, of the phosphor layer, in a direction perpendicular to the base need not be increased. The proportional relationship between the X-ray passage distance and the luminance is limited by the types of phosphors. If the film thickness is noticeably large, the transmission amount of light in the phosphor layer is decreased, and does not contribute to an improvement of luminance. Therefore, the peripheral portion of the phosphor layer has a thickness distribution in that the thickness is decreased from the thickest portion toward the periphery.

In the case of the I.I. comprising the phosphor layer having the above-mentioned film thickness distribution, influences of the respective factors on the luminance of the output image are as shown in FIG. 7, and the luminance of the output image can become uniform upon a combination of these influences.

Figure 8:
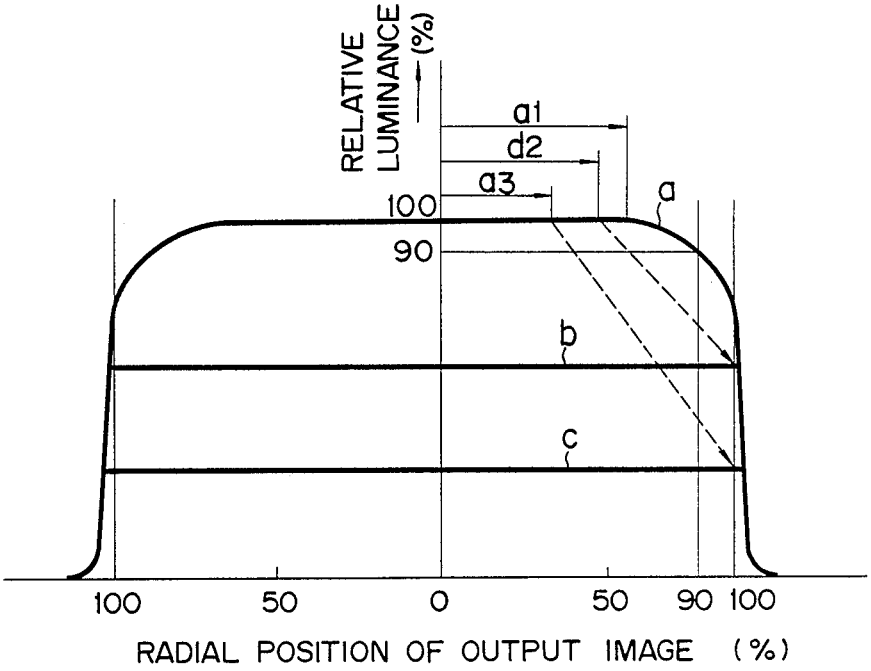

FIG. 8 shows the luminance distribution of the output image obtained by the variable visual field type I.I. having the above-mentioned input surface 18. In FIG. 8, each luminance distribution curve indicates a change in luminance along the radial direction of the output image. The abscissa represents a position along the radial direction of the output image, 0 is the center of the image, and 100 is the periphery of the image. The ordinate represents a relative luminance. A curve a represents a luminance distribution in the normal visual field operation mode, curve b represents a luminance distribution in the second visual field operation mode, and curve c represents a luminance distribution in the third visual field operation mode, respectively. In any visual field operation mode, the size of the output image is the same.

In the normal visual field operation mode, the luminance of a range 60 to 80% from the center of the image, i.e., of a range of radius a1, is at a substantially identical level, as can be seen from curve a. A decrease in luminance at a 90% position with respect to the luminance at the center of the image is very small, i.e., 10% or less, and the image has a substantially uniform brightness (gain) over the wide range.

In the second visual field operation mode, a region of radius a2 located with the range of radius a1 of the image in the normal visual field operation mode is enlarged upon switching of the visual fields, and is moved in the radial direction. As a result, the luminance distribution of the image becomes flat rather than that in the normal visual field operation mode, as indicated by curve b, and the entire image can have a uniform brightness.

In the third visual field operation mode, similarly, a region of radius a3 (a3<a2) of the image in the normal visual field operation mode is enlarged and is moved in the radial direction. As a result, the luminance distribution of the image becomes flat.

Differences in relative luminances of the respective visual fields are caused by differences in image enlargement ratio. Upon switching between the normal visual field and the second visual field, an image having the luminance distribution of curve a and an image having the luminance distribution of curve b are alternately projected. The decreased luminance portion of the normal visual field image corresponds only to an annular portion located at a 90 to 100% position of the image, and a region from the center of the image to the 90% position has a substantially uniform luminance. As described above, since the decreased luminance portion, i.e., a dark region, is small, movement of an image is not noticeable upon switching from the normal visual field to the second visual field. Contrary to this, upon switching from the second visual field to the normal visual field, the dark region appears at the periphery of the image. However, since the dark region is small, this region does not pose any problem to diagnosis. The luminance distribution of the normal visual field is flat from the center of the image to the 60 to 80% position. If the flat luminance portion is located between the center of the image to the 80% position, an area ratio of the flat luminance portion to the entire image is 0.64. If a region, in which a decrease in luminance is 10% or less, is included in the flat luminance portion, the area ratio is about 0.8. Therefore, almost the entire region of the image can have a uniform luminance. Although the above area ratio slightly varies in accordance with the types of the I.I., it preferably falls within the range of 0.6 to 0.8.

According to the I.I. of this embodiment as described above, the phosphor layer of the input surface has a thickest portion at the predetermined position, and is formed to have a thickness distribution corresponding to a change in influences of X-ray intensity, pincushion distortion, X-ray absorption distance, and the like, to the luminance. For this reason, the luminance of the entire output image can be flattened. If the luminance of the output image is uniform over the entire image, the following effects can be obtained.

For example, in the normal visual field operation mode, the decreased luminance region of the output image is very small, and data acquisition from the entire image is allowed, thus improving diagnosis capacity. In particular, in the case of diagnosis of the heart that requires image information as elaborate as possible, an image having a large observable region can be effectively obtained. For this reason, when an output image is imaged by a 100-mm spot by an indirect imaging method, an object can be observed from the entire surface of a negative film, and substantially the same effect as that in a direct imaging method can be obtained.

In the enlarged visual field operation mode, the luminance of the output image can become uniform over the entire region, and the uniform luminance distribution can compensate for drawbacks of a narrow input visual field in an enlarged imaging mode. The enlarged visual field has a higher resolution than that of the normal visual field, and the entire output image can be subjected to diagnosis. Therefore, this is effective for diagnosis of a minute portion.

When an X-ray diagnostic apparatus is equipped with an I.I. having the flat luminance distribution characteristic in the respective visual fields, a luminance compensation apparatus and a control system need not be arranged between an imaging system and an image display unlike in the conventional apparatus. The flat luminance distribution characteristic is advantageous for imaging processing.

According to the phosphor layer having the above-mentioned thickness distribution, noise can be reduced by increasing the thickness without adversely influencing the luminance distribution characteristic of the output image, and the entire output image can be at an identical noise level.

The present invention is not limited to the above embodiment, and various changes and modifications may be made within the spirit and scope of the invention.

For example, the present invention is not limited to the variable visual field type I.I. but can be applied to a single visual field type I.I. In the thickness distribution of the phosphor layer, the thickness increasing rate, the position of the thickest portion, and the like can slightly vary in accordance with the types of X-ray tubes and types of visual field sizes. For example, the following table shows the relationship between the thickness of the phosphor layer and the relative luminance when the thickest portion is located at a position separated from the center of the phosphor layer by a distance 70% of the effective radius. The thickness can fall within the range shown in the table. In the table, the first row shows a range wherein a maximum luminance can be obtained, and the second row shows a range wherein a practical luminance can be obtained.

TABLE

| | Radial Position of Phosphor Layer | | |
|---|---|---|---|
| | 0% (Center) | 70% (Thickest portion) | 100% (Periphery) |
| Thickness (μm) (Maximum luminance) | 380~450 | 400~470 | 190~450 |
| Thickness (μm) (Practical luminance) | 280~550 | 290~580 | 140~550 |

What is claimed is:

1. An X-ray image intensifier comprising:

a substantially cylindrical housing having two closed ends;

a circular input surface arranged in the housing along one end thereof;

an output surface arranged in the housing along the other end thereof and facing the input surface; and an electrode arranged in the housing between the input and output surfaces, wherein the input surface includes a base and a phosphor layer formed on the base and having a predetermined effective radius, and the phosphor layer includes a thickest portion which has a thickness about 105 to 115% of a thickness of a center of the phosphor layer and is located in a region separated from the center of the phosphor layer toward the periphery thereof by a distance about 60 to 80% of the effective radius, and is formed so that the thickness is gradually increased from the center to the thickest portion, and a region between the thickest portion and the periphery of the phosphor layer has a thickness about 50 to 100% of the thickness of the thickest portion.

2. An X-ray image intensifier according to claim 1, wherein the thickness of the center of said phosphor layer is set to be 230 to 530 μm.

3. An X-ray image intensifier according to claim 1, wherein the thickness of said phosphor layer is increased at a rate of 0.2 to 1.5 μm/cm from the center to the thickest portion along the radial direction of the phosphor layer.

4. An X-ray image intensifier according to claim 1, wherein the thickness of said phosphor layer is decreased at a rate of 0 to 7 μm from the thickest portion to the periphery along the radial direction of the phosphor layer.

5. An X-ray image intensifier according to claim 1, wherein said phosphor layer consists of an alkali halide deposition film.

6. An X-ray image intensifier according to claim 1, wherein said phosphor layer consists of columnar crystals having a diameter of 15 μm or less.

7. An X-ray image intensifier according to claim 1, wherein said input surface includes a normal visual field having the same radius as the effective radius of the phosphor layer, and a second visual field having a radius smaller than the radius of the normal visual field, and the thickest portion is located outside the second visual field.

* * * * *